US007137616B2

(12) United States Patent
Kysely

(10) Patent No.: US 7,137,616 B2
(45) Date of Patent: Nov. 21, 2006

(54) POLE PULLING DEVICE

(76) Inventor: Joseph H. Kysely, N2265 Hwy. E., Palmyra, WI (US) 53156

( * ) Notice: Subject to any disclaimer, the term of this patent is extended or adjusted under 35 U.S.C. 154(b) by 106 days.

(21) Appl. No.: 10/914,590

(22) Filed: Aug. 9, 2004

(65) Prior Publication Data

US 2006/0027793 A1 Feb. 9, 2006

(51) Int. Cl.
*E21B 19/00* (2006.01)

(52) U.S. Cl. ..... 254/30; 254/4 R

(58) Field of Classification Search ..... 254/4 R, 254/134, 133 R, 128, DIG. 14, 30
See application file for complete search history.

(56) References Cited

U.S. PATENT DOCUMENTS

| | | | | |
|---|---|---|---|---|
| 953,234 | A | 3/1910 | Rountree | |
| 975,832 | A | 11/1910 | Clore | |
| 2,484,400 | A | 10/1949 | Brown | |
| 2,654,630 | A | 10/1953 | Renfroe | |
| 3,163,398 | A | 12/1964 | Eckels | |
| 3,173,658 | A | 3/1965 | Verrell et al. | |
| 3,233,968 | A | 2/1966 | Harvey et al. | |
| 3,239,263 | A | 3/1966 | Farmer et al. | |
| 3,647,185 | A | 3/1972 | Phibbs | |
| 4,082,192 | A | 4/1978 | Cox | |
| 4,256,286 | A | 3/1981 | Hudgins | |
| 4,327,534 | A | 5/1982 | Mastalski et al. | |
| 4,706,935 | A | 11/1987 | Thompson | |
| 4,822,006 | A | 4/1989 | McIntire | |
| 4,846,445 | A | 7/1989 | Pfeffer | |
| 5,195,726 | A * | 3/1993 | Kaner | 254/325 |
| 5,211,374 | A | 5/1993 | Head et al. | |
| 5,366,338 | A * | 11/1994 | Mortensen | 414/563 |
| 5,975,826 | A * | 11/1999 | Scholder | 414/444 |
| 6,056,271 | A | 5/2000 | Riojas | |
| 6,302,380 | B1 | 10/2001 | Ultimo, Sr. et al. | |
| 6,367,779 | B1 | 4/2002 | Martin et al. | |
| 6,382,594 | B1 | 5/2002 | Ransom | |
| 6,398,188 | B1 | 6/2002 | Salman | |
| 6,527,250 | B1 | 3/2003 | Tyson | |
| 6,598,856 | B1 | 7/2003 | Puff et al. | |
| 6,641,347 | B1 | 11/2003 | Ewington | |
| 6,669,172 | B1 | 12/2003 | Bearden | |
| 2006/0027793 | A1 * | 2/2006 | Kysely | 254/30 |

OTHER PUBLICATIONS

Article entitled: "Skid-Steer Sets Poles" by Roco North America, Apr. 21, 2004.

* cited by examiner

*Primary Examiner*—Lee D. Wilson
(74) *Attorney, Agent, or Firm*—Boyle Fredrickson Newholm Stein & Gratz S.C.

(57) ABSTRACT

A pole pulling device is provided for removing a pole from the ground. The pole pulling device includes a support structure extending along an longitudinal axis. A cable has a first end connectable to a support structure and a second end positionable about the pole. A slider assembly engages the cable and is slidable along an axis from a lowered position to an elevated position so as to remove the pole from the ground with the cable.

23 Claims, 8 Drawing Sheets

FIG. 4
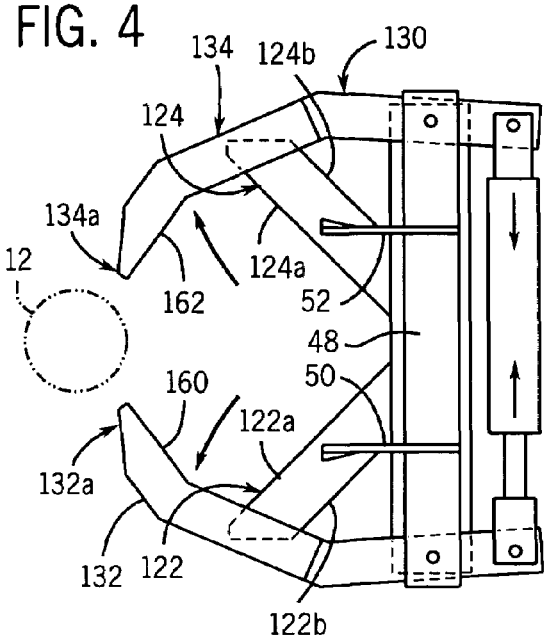
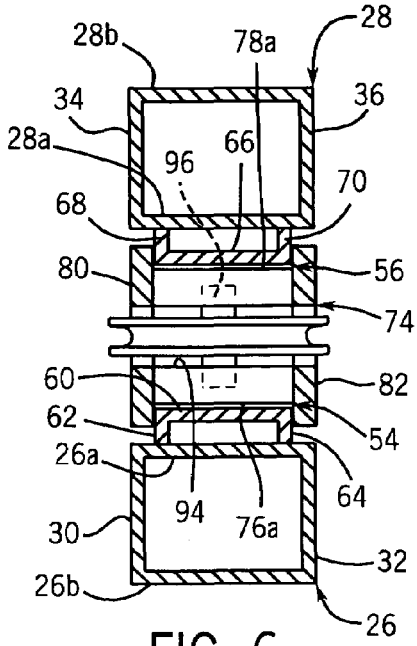
FIG. 6
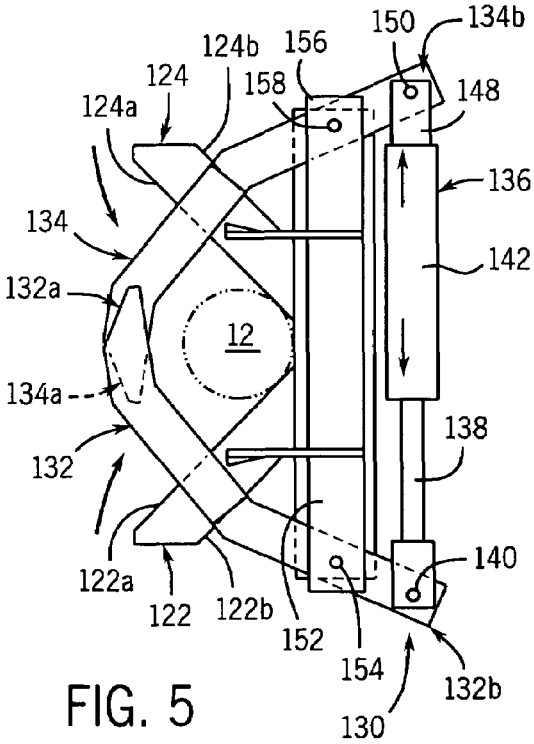
FIG. 5
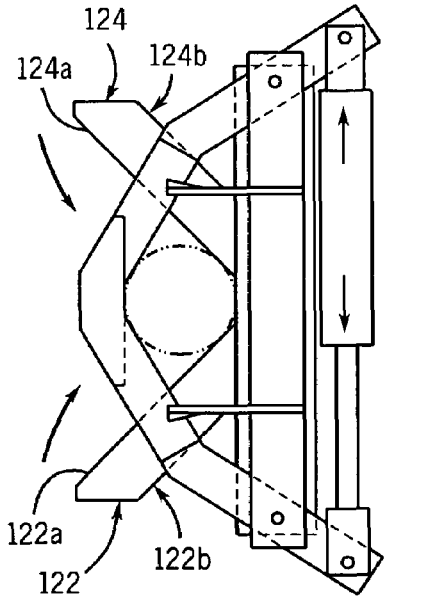
FIG. 7a

POLE PULLING DEVICE

FIELD OF THE INVENTION

This invention relates generally to the removal and/or replacement of wooden utility poles, light poles, sign poles or fence posts partially supported below ground level, and in particular, to a device for safely extracting a pole from the earth without damaging the pole or any surrounding structures.

BACKGROUND AND SUMMARY OF THE INVENTION

As is known, utility companies supply the public with various products including electrical power, telephone service, and natural gas. Electric utilities are continuously in the process of upgrading their distribution system infrastructure in order to be able handle the increase in electric demand and to improve the reliability of existing services. This upgrade typically involves the replacement of old wooden utility poles (in some cases 80–90 year old poles) with new wooden utility poles that are engineered for the heavier conductor loads and tensions and that provide additional clearance for the higher distribution voltages. Road widening projects may also force the electric utilities to relocate their existing facilities, even though these facilities are not necessarily in need of repair. However, both of these situations usually require the removal of existing wooden utility poles.

On a typical road-widening project, the electric utility will install a plurality of new poles and string a new conductor along the edge of the new road right of way. Once this new line is energized and electric customers are transferred over to the line, the electric utility will remove the old wires from the existing line and cut the tops of the poles off just above the communications circuits (telephone and cable TV). This procedure allows the owners of communications circuits to lift their facilities over the top of the cutoff pole and transfer their facilities to the new poles without cutting and splicing. Once the remaining facilities are relocated, the remaining portions of the poles must be removed.

It has been found that a very high percentage of new utility poles that are installed on an annual basis are actually replacement poles. For a mid-sized electric utility, this can equate to the removal and replacement of over 10,000 poles per year. As such, a safe and economic means for removing the utility poles is a necessity. Heretofore, various types of the pole pulling devices have been utilized by the electric utilities. For example, U.S. Pat. Nos. 3,163,398 and 3,173,658 disclose commercially available pole pulling devices that include hydraulic cylinders and base plate assemblies that are coupled to corresponding poles via chains that cinch the poles.

While functional for their intended purpose, these prior pole pulling devices are cumbersome to operate and have numerous disadvantages. By way of example, for rear lot line applications, prior pole-pulling devices need to be carted by hand over to the pole and then assembled. A portable hydraulic unit also needs to be carted over to the pole. Further, the chain method of cinching the pole is not very effective. The chain tends to roll and not "bite" into the outer periphery of the pole as the cylinder is extended. As a result, a wedge block must be installed (i.e., driven in with a sledge hammer) between the chain and the pole to keep the chain from slipping. Once the hydraulic cylinder is fully extended, the wedge block needs to be driven back out (again, with a sledge hammer) and the cylinder must be retracted and reattached to the pole. Because of the limited stroke of the hydraulic cylinder (typically 18–24-inches), this operation can be time consuming and labor intensive. It is also noted that on soft ground, the base on the hydraulic cylinder of a prior pole pulling device can sink into the ground during extraction, leading to more operational problems. Finally, since the hydraulic cylinder is fixed to the pole, the mechanical forces applied to the pole and to the cylinder tend to tip the pole away from the side of the pole on which the hydraulic cylinder is attached. As a result, the top of the pole may tip in an unwanted direction.

In view of the above-mentioned operational difficulties that utility line mechanics encounter when using these prior pole pulling devices, alternate methods for extracting utility poles from the earth have been developed. A preferred method used by utility line mechanics is to loosen the pole by wiggling it back and forth with a digger derrick truck. Thereafter, a derrick winch line is used to extract the pole. Digger derrick trucks are not designed for this application and this operation can lead to damage to the crane boom and turret assembly of the truck. Safety is a major concern when exceeding the design limits of the boom truck.

Other attempts have been developed to address some of the issues heretofore described. U.S. Pat. No. 4,822,006 is directed to mechanism for reducing the slippage of the chain used to pull the pole from the earth. The mechanism utilizes mechanical fingers that dig into the pole as the hydraulic cylinders are extended. However, the design of the mechanism in the '006 patent raises a number of issues. For example, the variations in pole diameters and lack of concentricity can lead to gripping problems. Further, any side load on the mechanical fingers due to the cylinder not being centered can lead to bending of the cylinder rod resulting in an expensive repair. In addition, the mechanical fingers exert substantial inward pressure on the pole prior to extraction, thereby leading to the possible crushing of the wood without ever extracting the pole. Finally, the limited stroke of the hydraulic cylinder requires multiple strokes of the cylinder to fully extract a pole, thereby requiring a substantial amount of time.

U.S. Pat. No. 4,327,534 addresses the issue of extracting the pole in a single stroke by extending the length of the hydraulic cylinder. Although this approach will work, there are still chain gripping issues and longer hydraulic cylinder rods are susceptible to damage. There are also ergonomic issues associated with installing the device next to the pole.

U.S. Pat. No. 6,641,347 utilizes a design that is mounted to a piece of mobile construction equipment. While adequate for accessible locations, the design is not well suited for rear lot line applications. One positive feature is that the large surface area of the base plate keeps the design from sinking into soft ground. Further, the design places the mechanical forces to the ground rather than the piece of construction equipment. However, since the design is mounted in a bucket, it does not allow for the bucket to be utilized to fill the hole left by the extracted pole. In addition, other problems associated with the design disclosed in the '347 patent include ergonomic issues with having to physically rotate the hydraulic cylinder into position, the limited stroke capability of the hydraulic cylinder, chain slippage issues and the fact that the utility pole has a tendency to tip away as the pole is extracted.

Therefore, it is a primary object and feature of the present invention to provide a pole pulling device that will safely and efficiently extract a utility pole from the earth.

It is a further object and feature of the present invention to provide a pole pulling device that minimizes the ergonomic impact to the machine operator.

It is a still further object and feature of the present invention to provide a pole pulling device that has the ability to be mounted on a small compact utility tractor that can be used to transport the pole pulling apparatus and that utilizes the tractor as a hydraulic power source.

It is a still further object and feature of the present invention to provide a pole pulling device that incorporates a means to lay the utility pole down on the ground after extraction without the use of a digger derrick truck.

It is a still further object and feature of the present invention to provide a pole pulling device that is simple to operate and inexpensive to manufacture.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 4 is a cross-sectional view of the pole pulling device of the present invention taken along line 4—4 of FIG. 1;

FIG. 5 is a cross-sectional view of the pole pulling device of the present invention taken along line 5—5 of FIG. 3;

FIG. 6 is a cross-sectional view of the pole pulling device of the present invention taken along line 6—6 of FIG. 1;

FIG. 7*a* is a cross-sectional view of the pole pulling device of the present invention taken along line 7*a*—7*a* of FIG. 7;

DETAILED DESCRIPTION OF THE DRAWINGS

Figure 1:
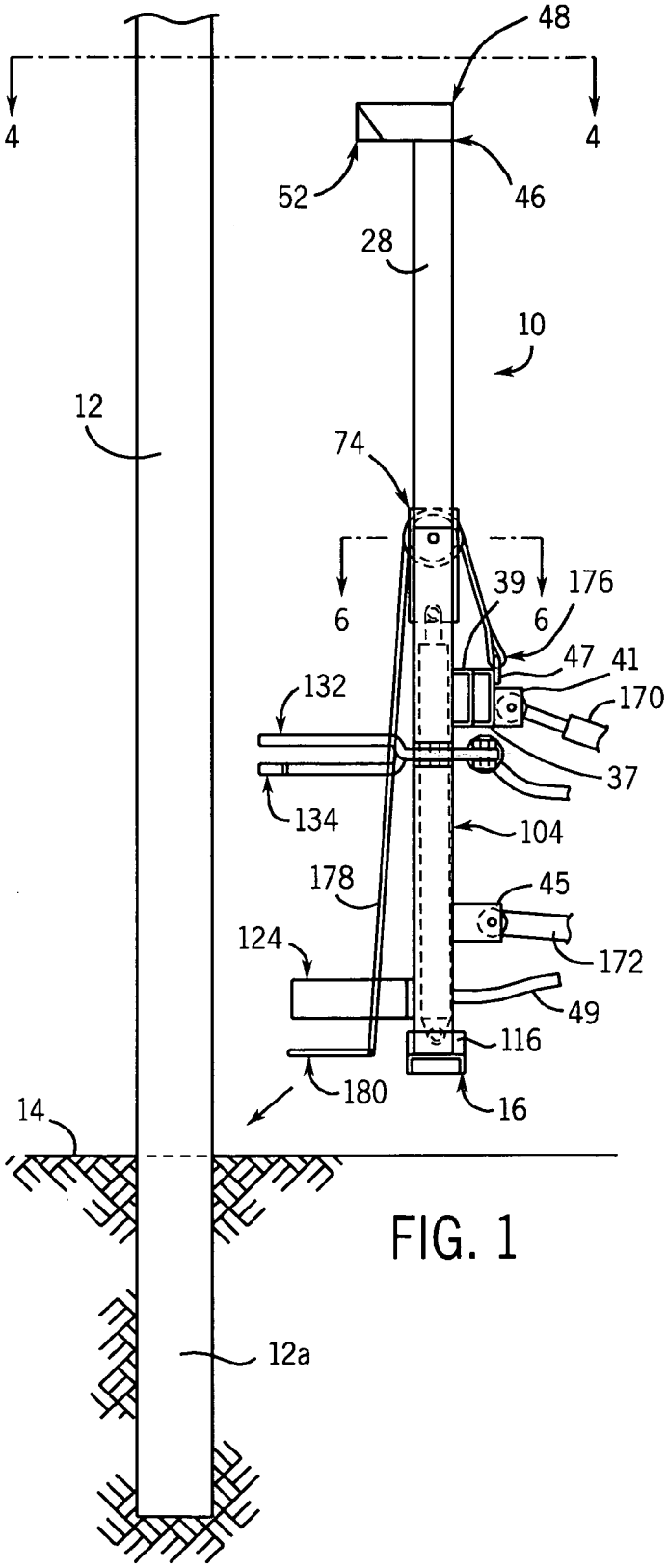
FIG. 1 is a side elevational view of a pole pulling device in accordance with the present invention positioned adjacent a pole to be extracted from the earth.

Referring to FIG. 1, a pole pulling device in accordance with the present invention is generally designated by the reference numeral 10. It is intended that pole pulling device 10 be used to remove a vertical pole, such as utility pole 12, from ground 14. It is noted, however, that pole pulling device 10 may be used to remove other vertical poles such as light poles, sign poles, or fence posts, from ground 14 without deviating from the scope of the present invention.

Figure 2:
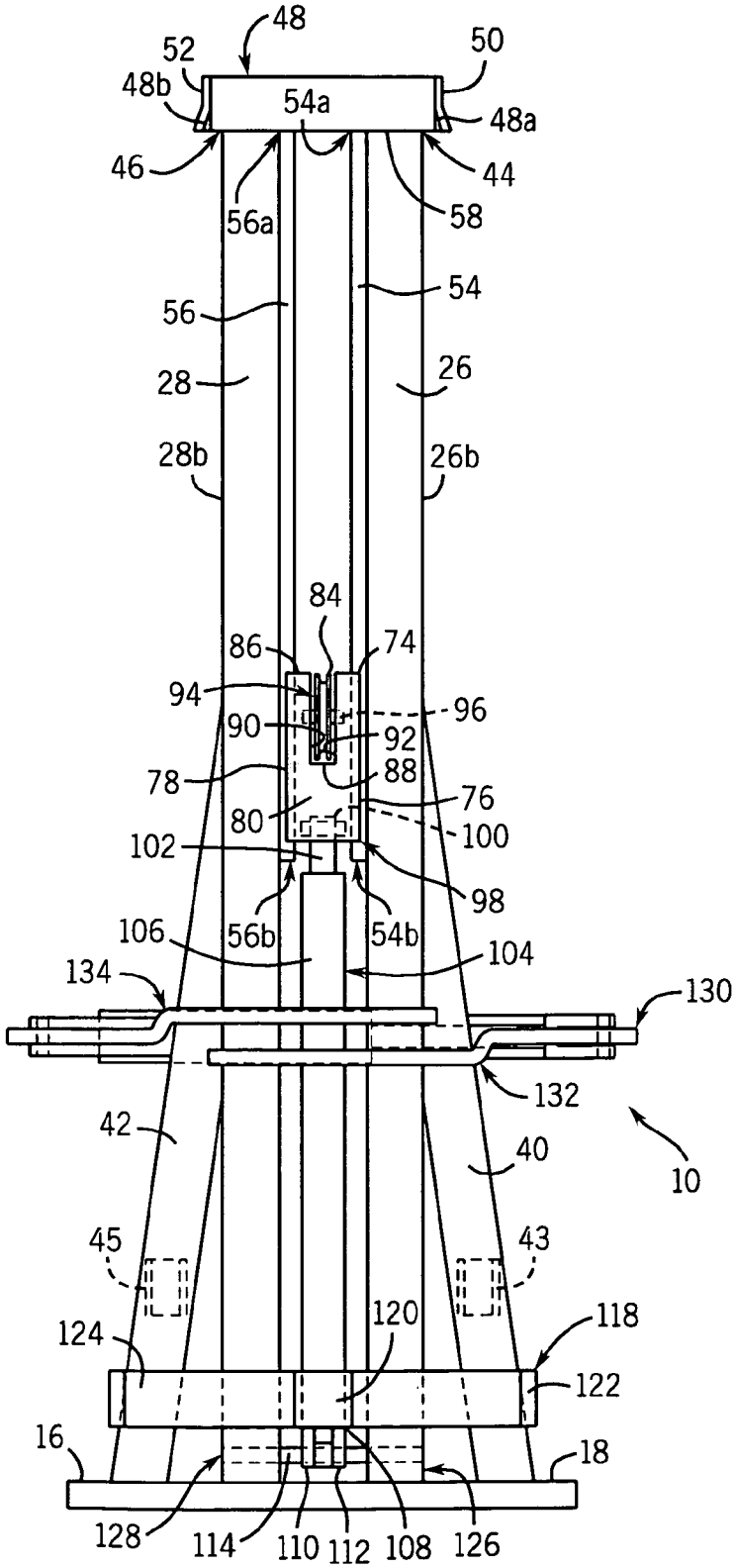
FIG. 2 is a front elevational view of the pole pulling device of the present invention.
Figure 3:
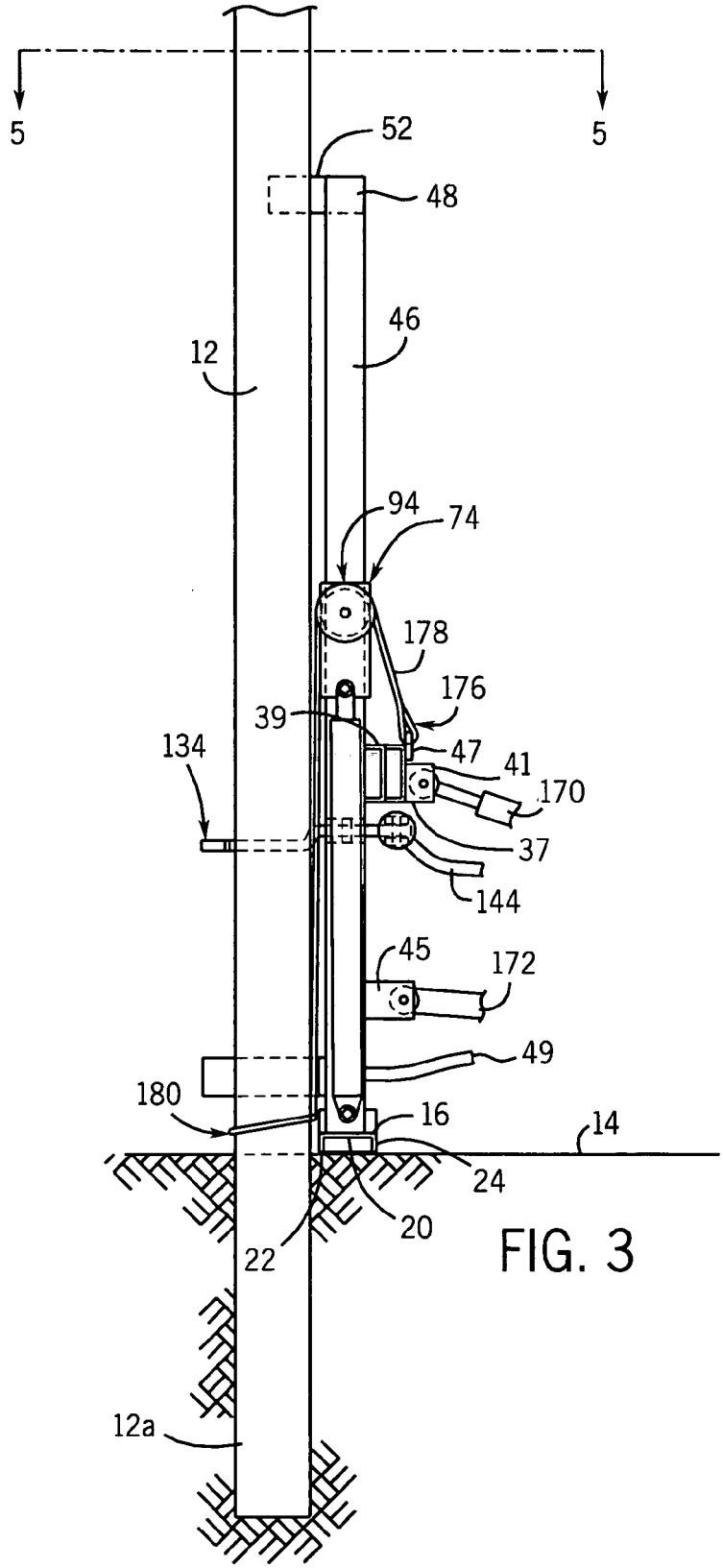
FIG. 3 is a side elevational view of the pole pulling device of FIG. 1 positioned about a pole to be extracted.

Referring to FIGS. 2–4, pole pulling device 10 includes an elongated base 16 having upper surface 18 and lower surface 20 directed towards ground 14. Base 16 is of sufficient dimension to prevent pole pulling device 10 from sinking into ground 14 during operation. First and second legs 22 and 24 depend from opposite sides of base 16 and are receivable in ground 14, for reasons hereinafter described. First and second spaced supports 26 and 28, respectively, extend vertically from upper surface 18 of base 16. Supports 26 and 28 are generally tubular and have a generally rectangular cross section. As best seen in FIG. 6, supports 26 and 28 include corresponding inner walls 26*a* and 28*a*, respectively, and corresponding outer walls 26*b* and 28*b*, respectively. Inner and outer walls 26*a* and 26*b*, respectively, of support 26 are interconnected by and spaced from each other by sidewalls 30 and 32, respectively. Similarly, inner wall 28*a* and outer wall 28*b* of support 28 are interconnected by and spaced from each other by sidewalls 34 and 36, respectively. As best seen in FIG. 1, spacers 37 and 39 are fixed to sidewalls 32 and 36 of supports 26 and 28, respectively. Spacers 37 and 39 overlap each other and include fixed mounting point 47 and mounting point 41 extending therefrom. It is intended that mounting point 41 be pivotably connectable to the terminal end of a piston of a conventional hydraulic cylinder, for reasons hereinafter described.

Angled support member 40 extends between upper surface 18 of base 16 and outer wall 26*b* of support 26. In addition, angled support member 42 extends between upper surface 18 of base 16 and outer wall 28*b* of support 28. As best seen in FIG. 2, mounting points 43 and 45 extend reawardly from angled support members 40 and 42, respectively, and are pivotably connectable to three point arms 172 and extend from a conventional compact utility tractor so as to operatively connect pole pulling device 10 to the utility tractor.

Upper ends 44 and 46 of supports 26 and 28, respectively, are interconnected by a generally tubular cross frame member 48. Guide wings 50 and 52 project laterally from corresponding ends 48*a* and 48*b*, respectively, of cross frame member 48 and define a recess therebetween for receiving pole 12, as hereinafter described. Pole pulling device 10 further includes first and second guide tracks 54 and 56, respectively, extending along inner walls 26*a* and 28*a*, respectively, of supports 26 and 28, respectively. Guide track 54 includes upper end 54*a* that abuts lower surface 58 of cross frame member 48 and lower end 54*b* vertically spaced from upper surface 18 of base 16. Guide track 54 is defined by generally flat inner guide wall 60 that lies in a plane generally parallel to inner wall 26*a* of support 26. Inner guide wall 60 of guide track 54 is spaced from and interconnected to inner wall 26*a* of support 26 by first and second sidewalls 62 and 64, respectively. Guide track 56 is defined by a generally flat inner guide wall 66 that lies in a plane generally parallel to inner wall 28*a* of support 28. Inner guide wall 66 of guide track 56 is interconnected to and spaced from inner wall 28*a* of support 28 by first and second sidewalls 68 and 70, respectively. As best seen in FIG. 6, sidewall 62 of guide track 54 and sidewall 68 of guide track 56 lie in a common plane. Similarly, sidewall 64 of guide track 54 and sidewall 70 of guide track 56 lie in a common plane. As hereinafter described, inner guide wall 60 of guide track 54 and inner guide wall 66 of guide track 56 are spaced from each other so as to accommodate slider block 74.

As best seen in FIGS. 2 and 6, slider block 74 includes first and second sides 76 and 78, respectively, and inner and outer faces 80 and 82, respectively. Recessed surfaces 76*a* and 78*a* are provided in sides 76 and 78, respectively, of slider block 74 and are adapted to form slidable interfaces with corresponding inner guide walls 60 and 66, respectively, of guide tracks 54 and 56, respectively. Sides 76 and 78 of slider block 74 overlap corresponding guide tracks 54 and 56, respectively, so as to prevent lateral movement of slider block 74 as it slides along guide tracks 54 and 56.

Slider block 74 further includes recess 84 in upper end 86 thereof. Recess 84 is defined by recessed surface 88 spaced from upper end 86 of slider block 74 by sidewalls 90 and 92. Rotatable cable sheave 94 is mounted on an axle extending between sidewalls 90 and 92 of slider block 74 along an axis generally perpendicular to guide tracks 54 and 56. As is conventional, cable sheave 94 includes a circumferentially extending groove therein for accommodating cable choker 178 to travel thereon. Lower end 98 of slider block 74 includes a recess for accommodating terminal end of piston 102 of conventional hydraulic cylinder 104. It is contemplated to interconnect housing 106 of hydraulic cylinder 104 to the hydraulic power source of a utility tractor through line 49. As is known, piston 102 is movable between a retracted position, FIGS. 2–3, and a fully extended position, FIG. 8, in response to the presence of hydraulic fluid within housing 106. Lower end 108 of hydraulic cylinder 104 includes first and second spaced ears 110 and 112 depending from housing 106. Pin 114 extends through ears 110 and 112 and is supported on a corresponding mounting block 116 for supporting hydraulic cylinder 104 on upper surface 18 of base 16.

Pole pulling device 10 further includes lower alignment mechanism 118 defined by central portion 120 having first and second alignment arms 122 and 124, respectively, diverging therefrom. Outer surface 122*b* of alignment arm 122 is affixed to lower end 126 of support 26. Similarly, outer surface 124 is interconnected to lower end 128 of support 28. As best seen in FIGS. 4–5 and 7*a*, inner faces 122*a* and 124*a* define an alignment cavity for receiving pole 12 therebetween.

Referring to FIGS. 2, 4–5 and 7*a*, pole pulling device 10 further includes a pole grappling structure generally designated by the reference numeral 130. Grappling structure 130 includes first and second grappling arms 132 and 134, respectively. Grappling arms 132 and 134 include first ends 132*a* and 134*a*, respectively, and opposite, second ends, 132*b* and 134*b*. Second ends 132*b* and 134*b* are interconnected by hydraulic cylinder 136. Hydraulic cylinder 136 includes piston 138 having a terminal end 140 pivotably connected to second end 132*b* of arm 132. Piston 138 is slidable in cylinder housing 142 between a first retracted position, FIG. 4, and a second extended position, FIG. 7*a*, in response to the volume of hydraulic fluid within cylinder housing 142. As is conventional, piston 138 is biased toward the retracted position. Cylinder housing 142 is interconnected to a hydraulic fluid source by line 144, FIG. 3. Hydraulic cylinder 146 is also pivotably connected to second end 134*b* of arm 134 through ear 148 extending from cylinder housing 142 and pivot pin 150. It is further noted that first arm 132 is pivotably connected to frame element 152 extending laterally from angled support member 40 by pivot pin 154 and second arm 132 is pivotably connected to frame element 156 extending laterally from angle support member 42 by pivot pin 158.

As described, with piston 138 of hydraulic cylinder 136 in its retracted position, first ends 132*a* and 134*a* of grappling arms 132 and 134, respectively, are separated so as to define passageway for pole 12 to be inserted between or removed from between grappling arms 132 and 134. As piston 138 of hydraulic cylinder 136 is extended, first ends 132*a* and 134*a* of grappling arms 132 and 134, respectively, move towards each other, and eventually overlap, so as to capture pole 12 therebetween. With piston 138 of hydraulic cylinder 138 of hydraulic 136 in its fully extended position, FIG. 7*a*, inner surfaces 160 and 162 of grappling arms 132 and 134, respectively, engage the outer periphery of pole 12 so as to prevent movement of pole 12 with respect to pole pulling device 10, for reasons hereinafter described.

In operation, pole pulling device 10 is interconnected to a compact utility tractor or other vehicle such as a pull behind trailer, skid loader or the like having an adaptable mount. Mounting point 41 is pivotably connected to the vehicle by hydraulic cylinder 170 and mounting points 43 and 45 are pivotably connected the vehicle by three point arms 172. With piston 138 in its retracted position, FIG. 4, the vehicle positions pole pulling device 10 adjacent pole 12 such that pole 12 is received between first and second alignment arms 122 and 124, respectively, first and second grappling arms 132 and 134, respectively, and first and second guide wings 50 and 52, respectively. With pole pulling device 10 positioned adjacent pole 12, legs 22 and 24 of base 16 are free to dig into ground 14 during operation of pole pulling device 10 to maintain the position of pole pulling device 10. Piston 138 is partially extended by hydraulic cylinder 136 such that first ends 132*a* and 134*a* of grappling arms 132 and 134, respectively, overlap, FIG. 5. It is noted that inner surfaces 160 and 162 of grappling arms 132 and 134 are spaced from the outer periphery of pole 12. Thereafter, first end 176 of a cable choker 178 is interconnected to fixed mounting point 47 of pole pulling device 10. Cable choker 178 is passed over cable sheave 94 and second end 180 of cable choker 178 is wrapped around and interconnected to pole 12 at a location adjacent ground 14, FIG. 3.

Figure 7:
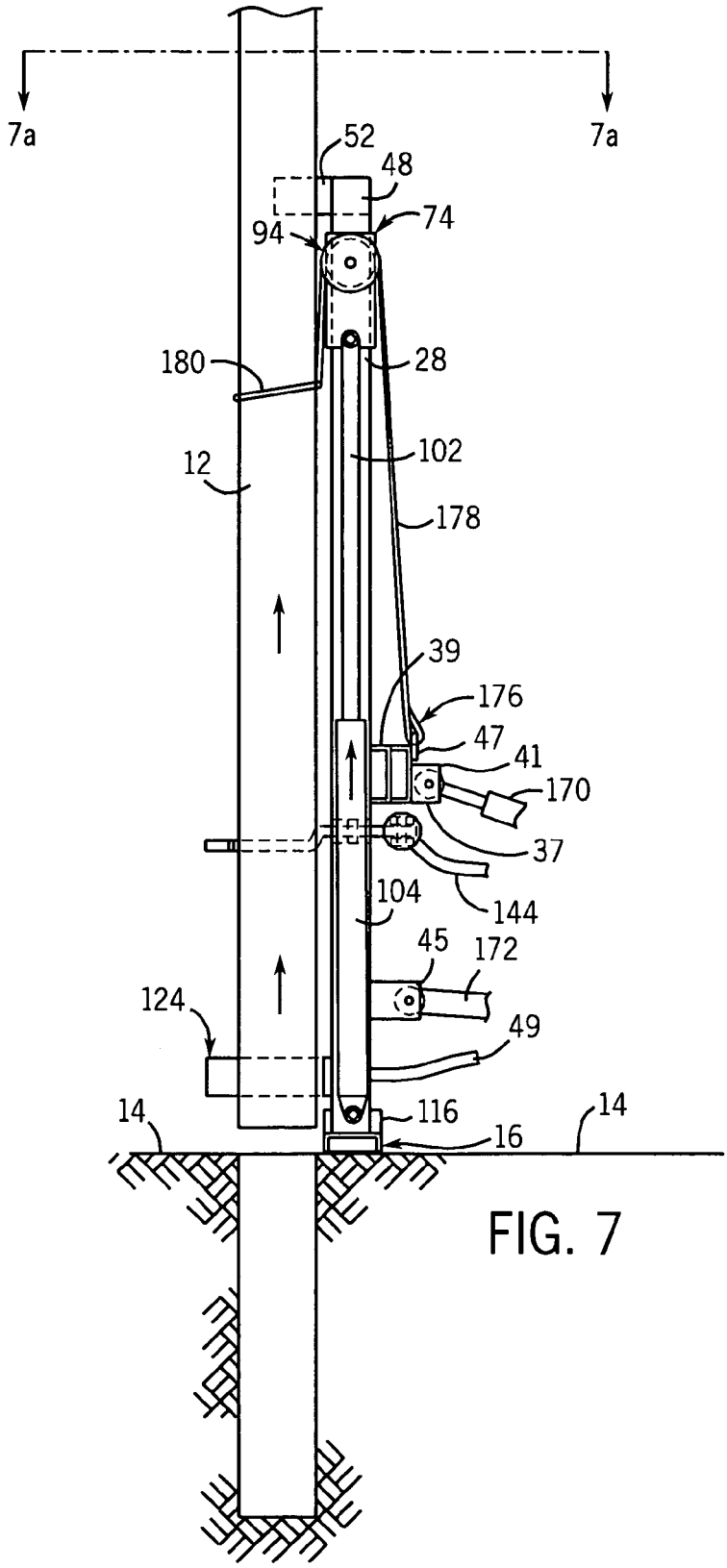
FIG. 7 is a side elevational view showing a pole pulling device of the present invention after extraction of a pole from the earth.

With cable choker 178 interconnected to pole 12, piston 102 of hydraulic cylinder 104 is extended to its extended position, FIG. 7, so as to urge slider block 74 vertically upward along guide tracks 54 and 56, respectively. As the slider block 74 is urged upwardly, cable choker 178 pulls pole 12 from ground 14. It is noted that given the arrangement of cable choker 178, the vertical distance traveled by second end 180 of cable choker 178 is generally equal to twice the vertical distance traveled by slider block 74. As a result, pole pulling device 10 allows pole butt 12*a* of pole 12 to be fully extracted from ground 14 with a single stroke of piston 102 of hydraulic cylinder 104. Alternatively, it is noted that first end 176 of cable choker 178 may be interconnected directly to slider block 74 without traversing cable sheave 94. As a result, the full output force generated by hydraulic cylinder 104 on piston 102 may be applied directly to those poles 12 that require additional force to be removed. As heretofore described, it can be appreciated with grappling arms 132 and 134 in their intermediate position, FIG. 5, pole 12 is free to slide vertically therebetween.

Figure 8:
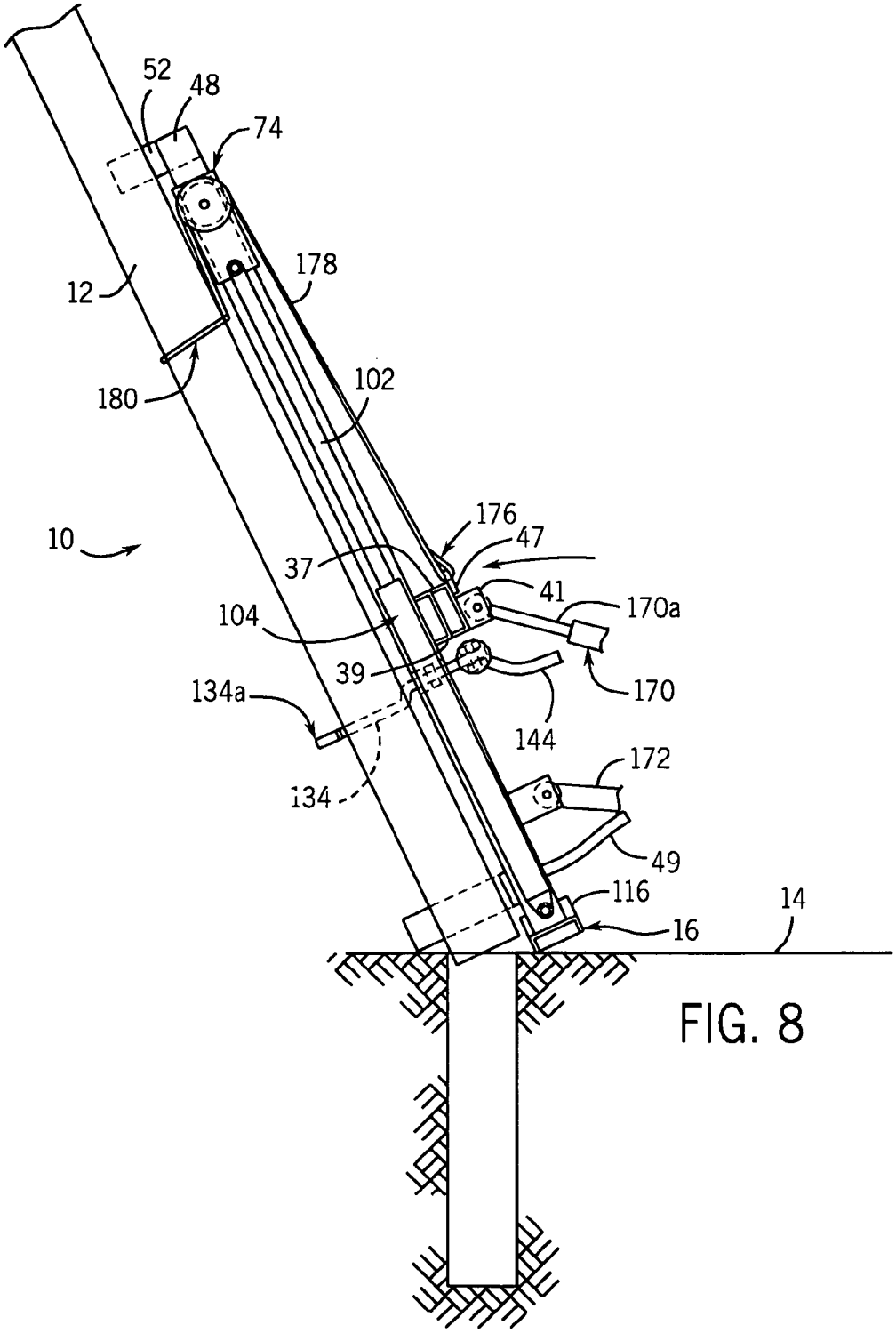
FIG. 8 is a side elevational view showing the pole pulling device of the present invention showing a first step for depositing the pole on the ground after extraction.
Figure 9:
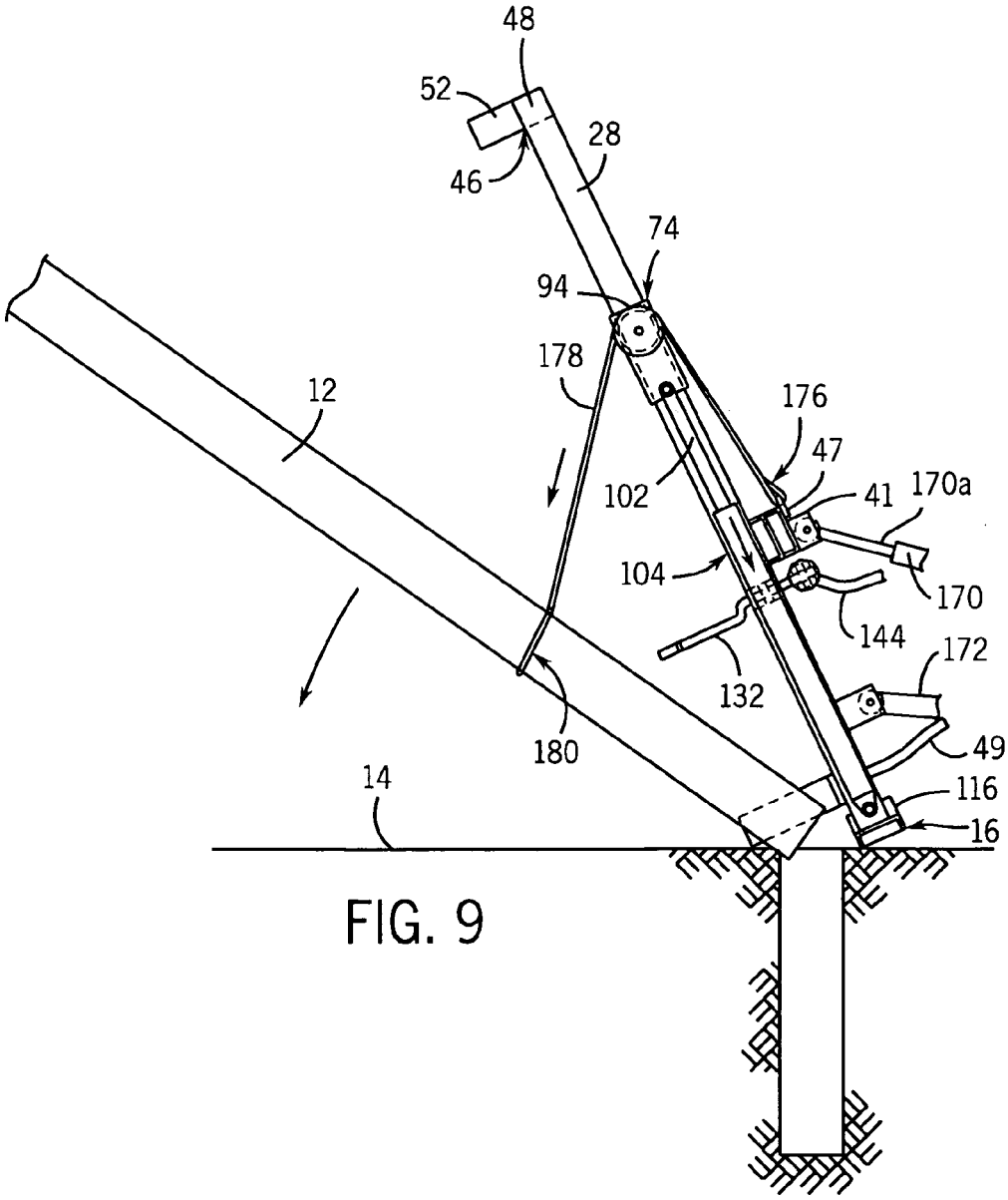
FIG. 9 is a side elevational view of the pole pulling device of the present invention showing an intermediate step for depositing the pole on the ground after extraction.
Figure 10:
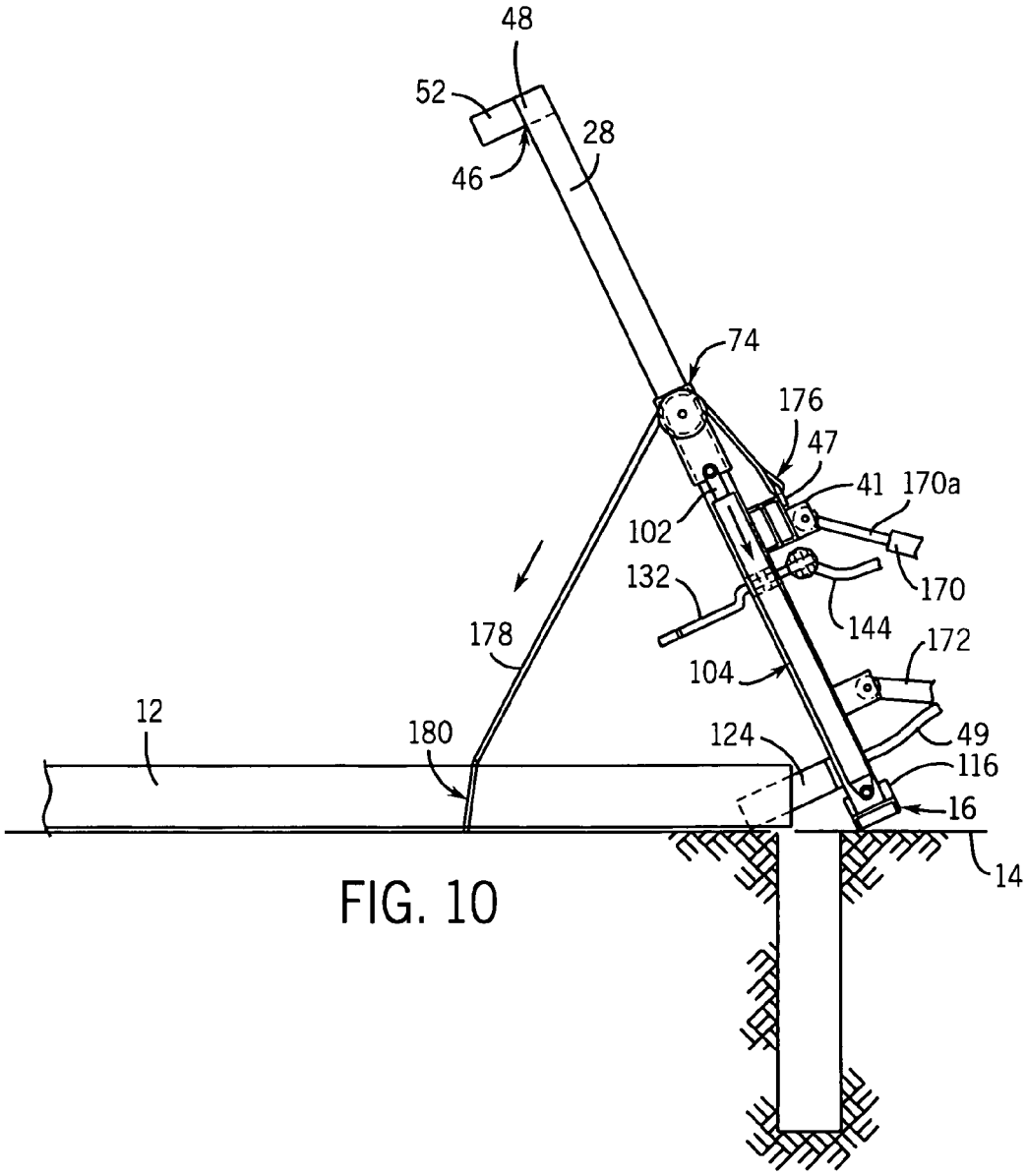
FIG. 10 is a side elevational view of the pole pulling device of the present invention showing the pole deposited on the ground after extraction.

With pole 12 fully extracted from ground 14, piston 138 of hydraulic cylinder 134 is moved to its fully extended position, FIG. 7*a*, such that the inner surfaces 160 and 162 of grappling arms 132 and 134, respectively, engage the outer periphery of pole 12 and prevent lateral and vertical movement of pole 12. Referring to FIGS. 8–10, in order to deposit pole 12 on ground 14 after extraction, piston 170*a* of hydraulic cylinder 170 is extended such that pole 12 is supported at a predetermined acute angle to ground 14. Thereafter, piston 138 of hydraulic cylinder 136 is moved to its retracted position, FIG. 4, and piston 102 of hydraulic cylinder 104 is retracted. As piston 102 of hydraulic cylinder 104 is retracted, slider block 74 slides downwardly along guide tracks 54 and 56 toward base 16 thereby increasing the length of cable choker 178 between slider block 74 and second end 180 of cable choker 178. As a result, pole 12 is free to pivot downwardly towards ground 14 and to pass through the opening between first ends 132*a* and 134*a* of grappling arms 132 and 134, respectively, FIG. 9. With piston 102 of hydraulic cylinder 104 fully retracted, FIG. 10, the length of cable choker 178 between second end 180 of cable choker 178 and slider block 74 is sufficient to allow pole 12 to be deposited on ground 14. Second end 180 of cable choker 178 may then be removed from about pole 12. Pole 12 may then be transported to a desired location. Pole pulling device 10 may then be used to remove another pole 10 from ground 14, as hereinafter described.

Various modes of carrying out the invention are contemplated as being within the scope of the following claims particularly pointing out and distinctly claiming the subject matter that applicant regards as the invention.

I claim:

1. A pole pulling device for removing a pole from the ground, the pole having a first lower end received in the ground and a second upper end, comprising:

a support structure extending along a longitudinal axis;

a cable having a first end connectable to the support structure and a second end, the cable being positionable about the pole; and a slider assembly engageable with the cable at a location between the first and second ends thereof, the slider being slidable along the longitudinal axis from a lowered position to an elevated position wherein the second end of the cable is drawn towards the support structure for removing the pole from the ground with the cable.

2. The pole pulling device of claim 1 wherein the slider is movable from the elevated position to the lowered position for depositing the removed pole on the ground.

3. The pole pulling device of claim 1 wherein the support structure defines a guide track for guiding the slider assembly between the lowered and the elevated positions.

4. The pole pulling device of claim 1 wherein the slider assembly includes a cable sheave rotatable about an axis transverse to the longitudinal axis, the cable sheave including a circumferentially extending groove for receiving the cable.

5. The pole pulling device of claim 1 further comprising a cylinder including an extendable shaft having a terminal end operatively connected to the slider assembly, the shaft moving the slider assembly between the retracted position and the extended position.

6. The pole pulling device of claim 1 further comprising first and second alignment members diverging from each other and extending from the support structure, the first and second alignment members lying in a plane perpendicular to the longitudinal axis and defining a cavity for receiving the pole.

7. A pole pulling device for removing a pole from the ground, the pole having a first lower end received in the ground and a second upper end, comprising:

a support structure including first and second generally parallel supports defining a guide track therebetween;

a cable having a first end connectable to the support structure and a second end, the cable being positionable about the pole; and a slider assembly engageable with the cable at a location between the first and second ends thereof, the slider being slidable along the guide track between first and second positions to move the second end of the cable and to remove the pole from the ground.

8. The pole pulling device of claim 7 wherein the slider assembly includes a cable sheave rotatable about an axis generally perpendicular to the first and second supports, the cable sheave including a circumferentially extending groove for receiving the cable.

9. The pole pulling device of claim 7 further comprising a cylinder including an extendable shaft having a terminal end operatively connected to the slider assembly, the shaft moving the slider assembly between the first and the second positions.

10. The pole pulling device of claim 7 further comprising first and second alignment members diverging from each other and extending from the support structure, the first and second alignment members lying in a plane perpendicular to the first and second supports and defining a cavity for receiving the pole.

11. A pole pulling device for removing a pole from the ground, the pole having a first lower end received in the ground and a second upper end, comprising:

a cable having a first fixed end and a second end positionable about the pole;

a slider assembly engageable with the cable at a location between the first and second end thereof, the slider and being slidable along an axis between first and second positions to move the second end of the cable and to remove the pole from the ground with the cable; and a cylinder including an extendable shaft having a terminal end operatively connected to the slider assembly, the shaft moving the slider assembly between the first and second positions.

12. The pole pulling device of claim 11 wherein the slider assembly includes a cable sheave rotatable about an axis generally perpendicular to the first and second supports, the cable sheave including a circumferentially extending groove for receiving the cable.

13. The pole pulling device of claim 11 further comprising:

a support structure including first and second generally parallel supports for guiding the slider between the first and second positions; and a first arm pivotably connected to the first support and a second arm pivotably connected to the second support structure, the first and second arms having first terminal ends and being movable between a first open position wherein the terminal ends of the first and second arms are spaced so as to allow the pole to be inserted between and removed from between the first and second arms and a second captured position wherein the terminal ends of the first and second arms overlap so as to capture the pole therebetween.

14. A pole pulling device for removing a pole from the ground, the pole having a first lower end received in the ground and a second upper end, comprising:

a support structure extending along a longitudinal axis;

a cable having a first end connectable to the support structure and a second end, the cable being positionable about the pole;

a slider assembly engageable with the cable and being slidable along the longitudinal axis from a lowered position to an elevated position for removing the pole from the ground with the cable; and first and second arms extending from the support structure, the first and second arms having first terminal ends and movable between a first open position wherein the terminal ends of the first and second arms are spaced so as to allow the pole to be inserted between and removed from between the first and second arms and a second captured position wherein the terminal ends of the first and second arms overlap so as to capture the pole therebetween.

15. The pole pulling device of claim 14 wherein the first and second arms are movable to a third holding position wherein the first and second arms are engageable with the pole.

16. The pole pulling device of claim 14 wherein the first and second arms are pivotably connected to the support structure and include second ends, the second ends interconnected by a cylinder.

17. A pole pulling device for removing a pole from the ground, the pole having a first lower end received in the ground and a second upper end, comprising:

a support structure including first and second generally parallel supports defining a guide track therebetween;

a cable having a first end connectable to the support structure and a second end, the cable being positionable about the pole;

a slider assembly engageable with the cable and being slidable along the guide track between first and second positions to remove the pole from the ground; and a first arm pivotably connected to the first support and a second arm pivotably connected to the second support structure, the first and second arms having first terminal ends and being movable between a first open position wherein the terminal ends of the first and second arms are spaced so as to allow the pole to be inserted between and removed from between the first and second arms and a second captured position wherein the terminal ends of the first and second arms overlap so as to capture the pole therebetween.

18. The pole pulling device of claim 17 wherein the first and second arms are movable to a third holding position wherein the first and second arms are engageable with the pole.

19. The pole pulling device of claim 17 wherein the second ends of the first and second arms are interconnected by a cylinder.

20. A pole pulling device for removing a pole from the ground, the pole having a first lower end received in the ground and a second upper end, comprising:

a cable having a first fixed end and a second end positionable about the pole;

a slider assembly engageable with the cable and being slidable along an axis between first and second positions to remove the pole from the ground with the cable;

a cylinder including an extendable shaft having a terminal end operatively connected to the slider assembly, the shaft moving the slider assembly between the first and second positions;

a support structure including first and second generally parallel supports for guiding the slider between the first and second positions; and a first arm pivotably connected to the first support and a second arm pivotably connected to the second support structure, the first and second arms having first terminal ends and being movable between a first open position wherein the terminal ends of the first and second arms are spaced so as to allow the pole to be inserted between and removed from between the first and second arms and a second captured position wherein the terminal ends of the first and second arms overlap so as to capture the pole therebetween.

21. The pole pulling device of claim 20 wherein the first and second arms are movable to a third holding position wherein the first and second arms are engageable with the pole.

22. The pole pulling device of claim 20 wherein the second ends of the first and second arms are interconnected by a cylinder.

23. The pole pulling device of claim 20 further comprising first and second alignment members diverging from each other and extending from corresponding supports, the first and second alignment members lying in a plane perpendicular to the first and second supports and defining a cavity for receiving the pole.

* * * * *